United States Patent [19]

Weil et al.

[11] 3,982,745

[45] Sept. 28, 1976

[54] FABRIC SUPPLYING AND CUTTING SYSTEM

[76] Inventors: Bernard H. Weil, 13, Av. Foch; Didier R. Weil, 3, Rue Jean de Bry, both of 25000 Besancon, France

[22] Filed: Apr. 11, 1975

[21] Appl. No.: 567,105

Related U.S. Application Data

[63] Continuation-in-part of Ser. No. 513,854, Oct. 10, 1974, abandoned.

[30] Foreign Application Priority Data

Oct. 11, 1973 France ..... 73.36352

[52] U.S. Cl. ..... 270/31; 214/1 BB; 214/6 R; 214/16 B; 214/89; 214/658; 242/55

[51] Int. Cl.[2] ..... B65H 29/46

[58] Field of Search ..... 214/1 BB, 89, 658, 6 M, 214/6 R, 16 B; 242/55; 270/30–31

[56] References Cited

UNITED STATES PATENTS

| | | | |
|---|---|---|---|
| 3,776,541 | 12/1973 | Stumpf | 270/31 |
| 3,904,050 | 9/1975 | Kimura | 214/89 |

*Primary Examiner*—Robert J. Spar
*Assistant Examiner*—George F. Abraham
*Attorney, Agent, or Firm*—Robert E. Burns; Emmanuel J. Lobato; Bruce L. Adams

[57] ABSTRACT

Rolls of fabric wound on stiff supporting tubes having projecting ends and stored in a storage room located below a cutting room having at least one cutting table are delivered by a chain conveyor, which supports the rolls by the projecting ends of the tube, to an elevator at one end of the cutting table. The elevator lifts the rolls one at a time by the projecting ends of the tubes to a height above the cutting table whereupon the elevated roll rolls down inclined rails supporting the projecting ends of the tube onto a carriage having bearings for rotatably supporting the roll by the projecting tube ends. The carriage spans the cutting table and runs on rails at opposite sides of the cutting table. The carriage has a platform for carrying an operator and a control panel having controls for the carriage, the conveyor and the elevator. An overhead travelling hoist for lifting partially used rolls from the carriage and returning them to the storage room is also controlled from said control panel.

12 Claims, 12 Drawing Figures

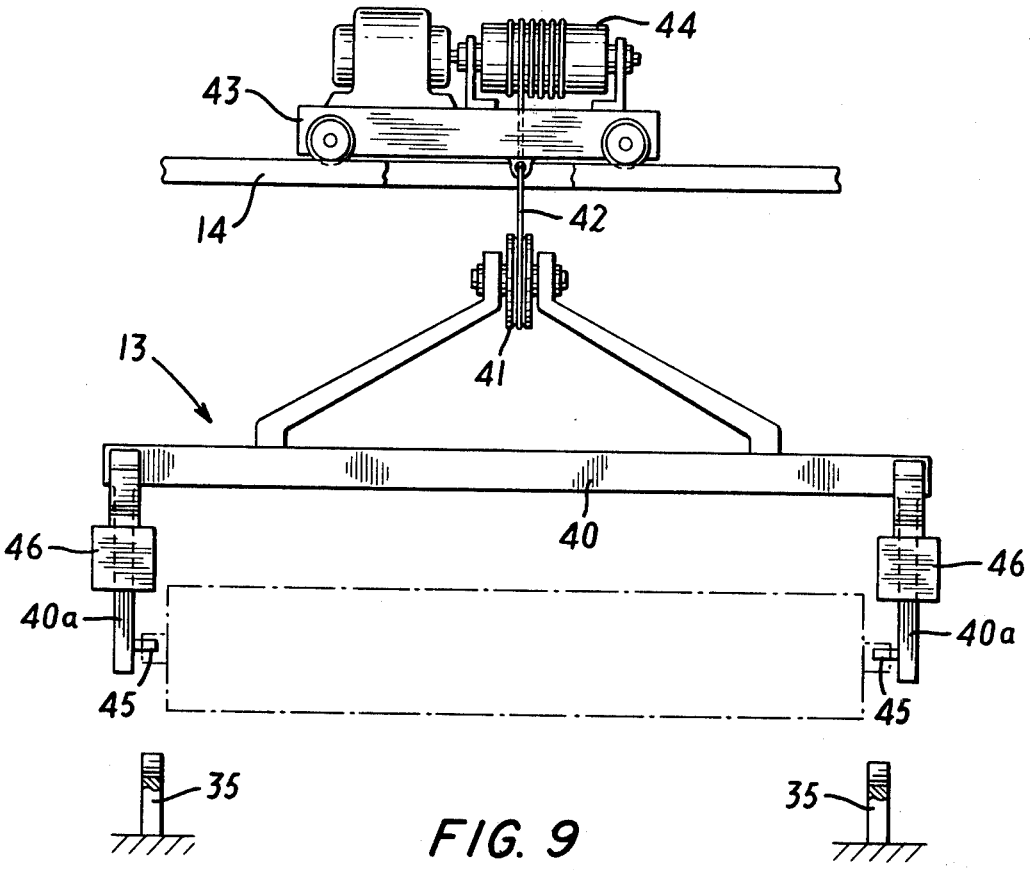
FIG. 9
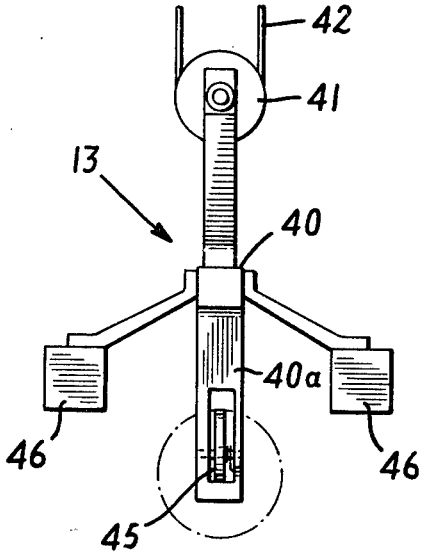
FIG. 10
FIG. 11
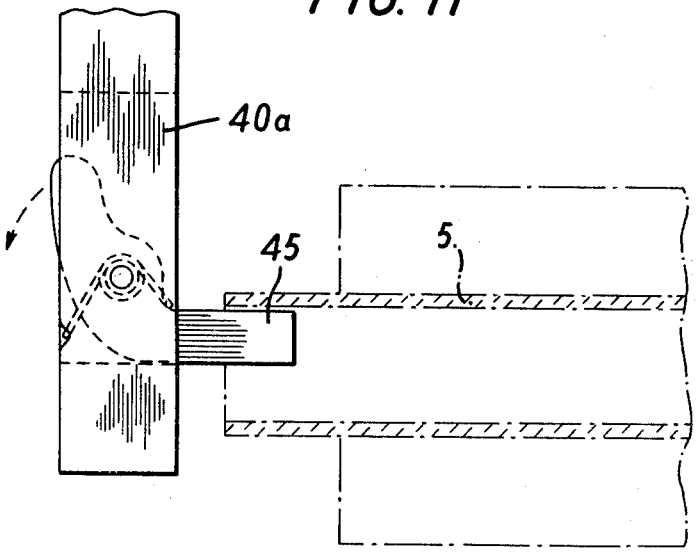

FABRIC SUPPLYING AND CUTTING SYSTEM

REFERENCE TO PRIOR APPLICATION

This application is a continuation-in-part of my application Ser. No. 513,854, filed Oct. 10, 1974, now abandoned.

FIELD OF INVENTION

The present invention relates to a system for supplying fabric and laying it in superposed layers on a cutting table in a cutting room of an industrial garment factory or other fabricating plant using fabric cut to a selected pattern.

BACKGROUND OF INVENTION

In an industrial garment factory fabric from which the garments are to be made is laid in superposed layers on a long cutting table where the multiple layers are simultaneously cut to provide fabric parts which are thereafter assembled to form garments. The fabric is spread out on the cutting table by a fabric laying machine comprising a carriage which spans the cutting table and travels on rails at opposite sides of the table. The carriage carries a roll of fabric which is unwound as the carriage moves along the table to spread the fabric on the table. The movements of the carriage are controlled by an operator who rides on a platform rigidly attached to the carriage and controls the carriage by means of a control panel mounted on the carriage. The upper portion of the carriage has bearing means for rotatably supporting a roll of fabric to be cut in such manner that the fabric is spread over the table as the carriage moves along the rails. The table proper may be composed of a series of endless belts which permit bringing the superposed layers of fabric to the cutting shop. The length of fabric previously brought from a storage room are wound on tubular supports which are generally made of cardboard.

Different devices have been proposed for supplying lengths of fabric to the fabric laying machine. Some such devices use an overhead conveyor for carrying the pieces of fabric on beams while others entail the mounting of the fabric on unwinding supports and the placing of the lengths of fabric thus prepared on a pallet truck which is brought from the storage room to the cutting room by a pallet truck or other suitable handling device.

The known devices have a certain number of drawbacks. The lengths of fabric are customarily delivered by the weaving factory wound on a cardboard tube. In order to unwind the fabric it is necessary to reinforce the cardboard core either by a metal shaft provided at one end with a gear cone or to rewind the fabric on a rigid beam. In the former case the placing of a length of fabric on the unwinding carriage is made more difficult by the weight of the fabric-shaft combination while in the latter case, the storing of the lengths of fabric before use and after the rolls are partially used is made more difficult either by the size or by the weight of the shaft which must be sufficiently rigid to support the fabric on the unwinding pedestals of the carriage. Furthermore the need of having as many shafts as lengths of fabric in operation and in storage represents a substantial investment.

If lengths of fabric are supplied to the fabric laying machine by an overhead conveyor it is necessary to provide sufficient height for such device as well as large free spaces for the passage of the suspended fabric rolls from the storage room to the fabric laying machine. When the fabric is supplied by pallet trucks a sufficient number of these trucks must be prepared in advance depending on each work program. In either case no provision is made for taking up and storing partially used lengths of fabric nor for placing the fabric on a rigid beam.

The problem to be solved thus consists of:

1. Finding a rigid, lightweight fabric support of sufficiently low cost so that it can be supplied directly with the fabric by the weaving mill;
2. Providing a device for supplying the cutting room with rolls of fabric which is continuous from the storage room to the unwinding carriage;
3. Eliminating the manual loading and unloading of lengths of fabric.

SUMMARY OF INVENTION

It is another object of the present invention to provide a solution to the foregoing problem by providing an improved method for supplying fabric and laying it in superposed layers on a cutting table and apparatus for carrying out the method.

In accordance with the invention the fabric is wound on rigid tubes to form rolls. The tubes project from opposite ends of the roll and are sufficiently strong to support the rolls by the projecting ends of the tube. At the same time the tubes are lightweight and of low cost. Preferably the tubes are formed of rigid plastic but may be formed of other suitable material for example metal, wood or sized cardboard.

The rolls of fabric are stored in a storage room located below the cutting room and are placed in succession on a belt conveyor which transports them up to the cutting room and delivers them to an elevator located at one end of the cutting table. The belt conveyor supports the rolls of fabric by the projecting ends of the tube on which the fabric is wound and preferably comprises two parallel chains some of whose links disposed symmetrically opposite to each other on the two chains bear teeth which are curved in the direction of travel with a curvature, the radius of which is equal to that of the tube.

The elevator located at an end of the cutting table receives the rolls of fabric one at a time from the belt conveyor and lifts them to a level above the cutting table. The elevator is pneumatically, hydraulically or electromechanically operated. When the roll of fabric has been elevated to a selected height, it is transferred from the elevator to the carriage of the cutting table. The transfer is preferably effected by allowing the roll to roll down inclined rails which support the roll by the projecting ends of the tube. Preferably the elevator is provided with two forks which are engageable with projecting ends of the tube on which the fabric is wound and assure the taking over of a roll from the conveyor, the elevating of the roll and its ejection to the means for transferring the roll to the carriage. The carriage is provided at each end with a roller bearing for rotatably supporting the tube of the roll of fabric. The bearings are capable of being pivoted so as to free the tube and permit it to roll onto a support for a partially used roll of fabric. An overhead hoist is preferably provided for removing a partially used roll of fabric from the carriage and transporting it back to the storage room below the cutting room.

Important advantages provided by the process in accordance with the present invention and the apparatus for carrying it out are as follows:

1. Simplification of the preparation of the rolls of fabric since it is unnecessary to wind the fabric on a special beam;

2. The possibility of storing a large number of rolls on a belt conveyor below the cutting table;

3. Elimination of all manual handling of the rolls of fabric from the time they are placed on the conveyor chain located at the level of the storage room;

4. Elimination of the unwinding shaft which has heretofore been necessary with rolls of fabric wound on cardboard tubes;

5. The possibility of lengthening the work table and supplying rolls of fabric to opposite ends of the table so as to permit the cutting of the superposed layers of fabric on one part of the table while fabric is being laid on another part of the table.

BRIEF DESCRIPTION OF DRAWINGS

Still other advantages of the invention will become evident from the following description of a preferred embodiment shown by way of example in the accompanying drawings in which:

FIG. 9 is a schematic elevational view of the hoist for removing partially used rolls from the carriage and returning them to the storage room;

FIG. 10 is a schematic side elevation of the fabric roll supporting tackle of the hoist;

FIG. 11 is a schematic view of a pivoted finger on one end of the roll supporting tackle of the hoist.

DESCRIPTION OF PREFERRED EMBODIMENT

Figure 1:
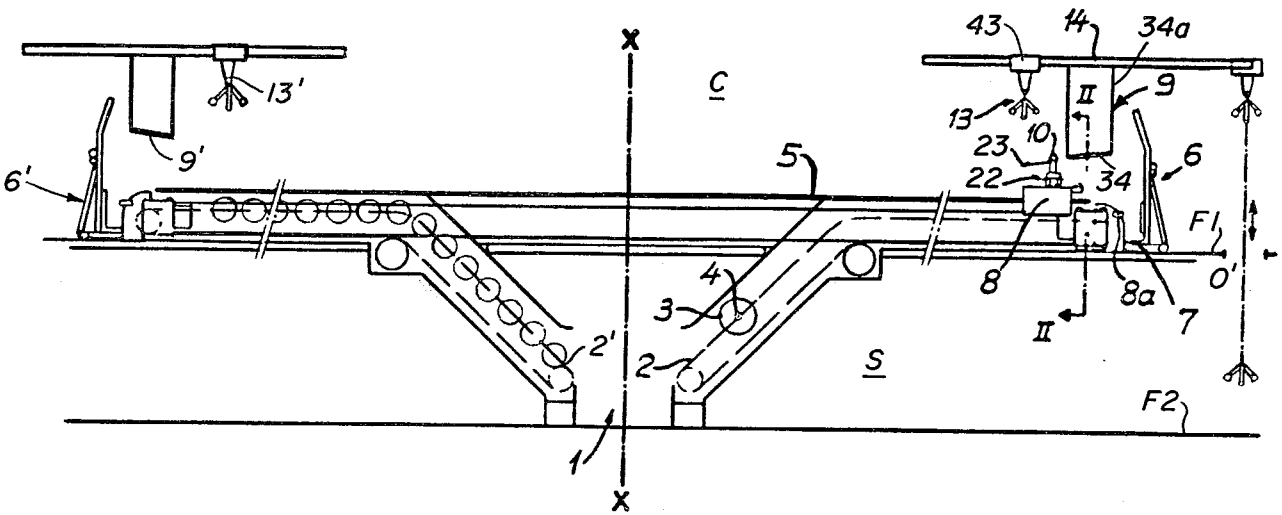
FIG. 1 is a schematic view of an installation in accordance with the invention.

FIG. 1 shows the general layout of the installation and its symmetry with respect to an axis x—x. The installation comprises an elongated cutting table 5 located in a cutting room C having a floor F1 on which the table rests. Rolls of fabric 3 which are to be cut are stored in a storage room S located below the cutting room and having a floor F2. The fabric rolls 3 are transported by a belt conveyor 2 from the storage room S up into the cutting room C and are delivered at either end of the cutting table 5. An elevator 6 takes the fabric rolls from the belt conveyor and lifts them one at a time to a level above the cutting table. The elevated roll is thereupon transferred to a carriage 8 which spans the cutting table in a transverse direction and runs on rails 15 provided at opposite sides of the cutting table. As the carriage moves along the rails 15 in a direction away from the elevator 6, the fabric is unwound from the roll and is spread on the cutting table 5. A partially used roll is thereafter removed from the carriage by an overhead tackle or hoist 13 which lifts the roll, transports it from over the cutting table and then lowers it down through an opening O in the cutting room floor F1 into the storage room S where it is stored for subsequent reuse.

It will be seen that the installation illustrated by way of example in FIG. 1 is symmetrical about the axis x—x there being two like belt conveyors 2 and 2′, two elevators 6 and 6′ located at opposite ends of the table and two overhead hoists 13 and 13′. However, there is only one carriage 8 which is used in the manner that while previously laid fabric is being cut on one half of the table, the carriage 8 is used to spread fabric in superposed layers on the other half of the table. The carriage 8 is thereafter moved to the other end of the table and used to spread fabric in superposed layers on the first mentioned half of the table while the fabric spread on the second mentioned half of the table is being cut.

Figure 2:
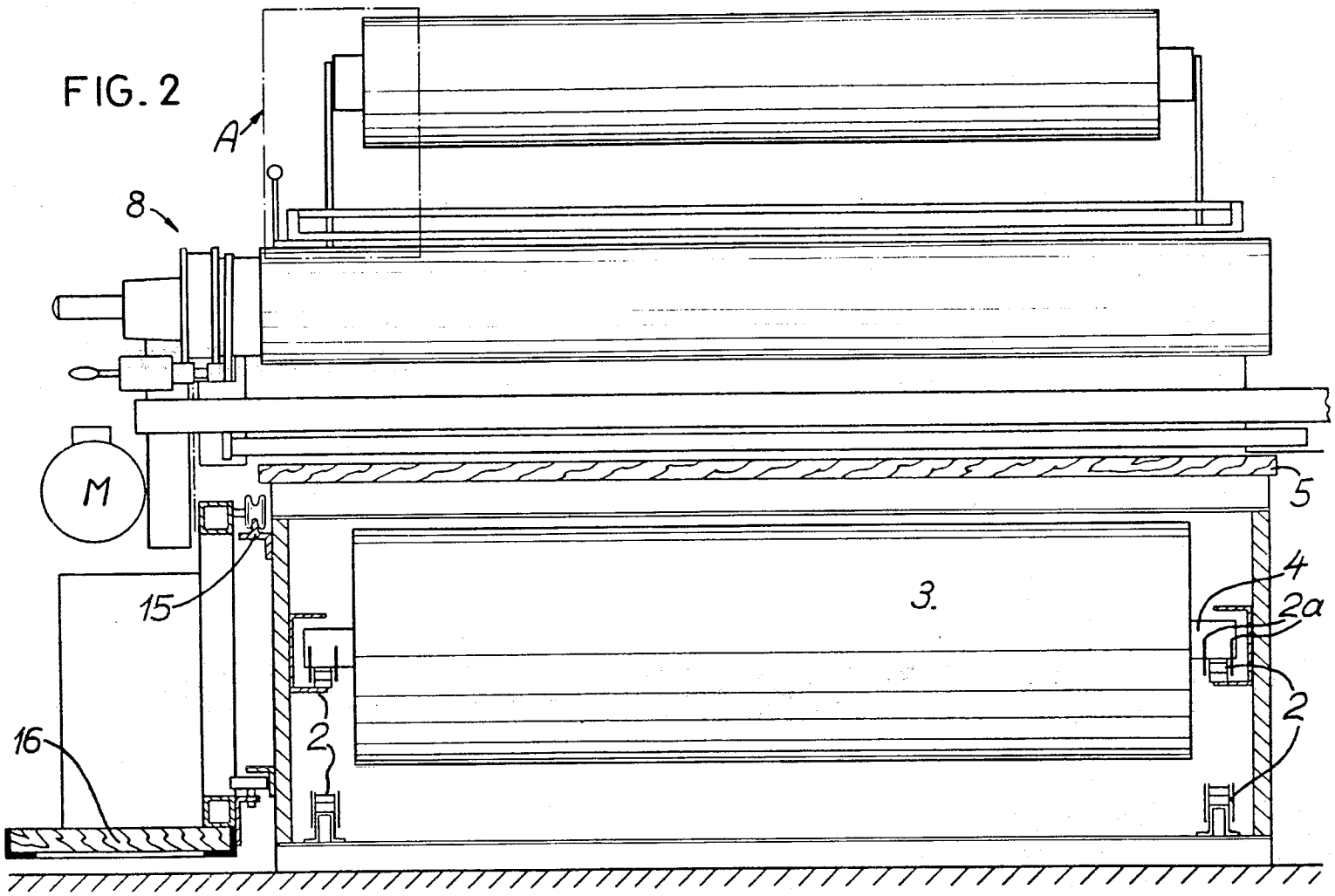
FIG. 2 is a partial sectional view taken along the line II—II in FIG. 1.

In accordance with the invention the fabric rolls 3 are formed by winding fabric on a support tube 4 which is longer than the width of the fabric so that the tube 4 projects from opposite ends of the fabric roll as clearly shown in FIG. 2. The support tubes 4 are of lightweight but are sufficiently stiff and strong to be capable of supporting the fabric roll by the projecting ends of the tube. The tubes are preferably formed of plastic which may if desired be suitable reinforced for example with glass cloth or glass fiber. However, any other suitable material such as metal, wood or sized cardboard may be used. The fabric is wound on the support tubes 4 at the weaving mill so that no rewinding of the fabric at the fabricating plant is required. The support tubes are sufficiently strong that it is not necessary to insert a shaft through the tube of a roll to support on the carriage for spreading the fabric on the cutting table 5.

The storage room S is which the rolls of fabric are stored in preparation for cutting is located directly below the cutting room C in which the cutting table 5 is located. It is of sufficient size to store the quantity of fabric required for a given cutting operation. Preferably the storage room is provided with horizontally extending rails or supports 35 which are spaced apart from one another so as to support rolls of fabric by the projecting ends of the support tubes 4. The fabric rolls are thereby supported up off of the floor of the storage and any flattening or other distortion of the rolls is avoided.

The belt conveyor 2 comprises two parallel chains which are spaced apart so as to receive the fabric rolls between them and support the rolls by means of the projecting ends of the support tube 4. Spaced links of the chain are provided with teeth 2*a* which are curved in the direction of travel of the chains with a curvature conforming to that of the support tubes 4. The projecting ends of the support tubes rest on the curved teeth 2*a* of the conveyor and thereby support the fabric rolls at selected spaced intervals along the chains. The supporting teeth 2*a* are preferably spaced apart along the chain a distance slightly greater than the diameter of a full roll of fabric. It will thus be seen that a considerable number of rolls of fabric are supported at any one time on the conveyor which thereby constitutes a portion of the fabric storing facilities of the installation.

As seen in FIG. 1 the conveyor 2 has an upwardly inclined portion which extends from a loading point 1 near the floor at a central portion of the storage room S up into the cutting room C below the cutting table 5. The conveyor then extends horizontally below the table to a location at the respective end of the table. The conveyor chains are supported by suitable rollers and are driven in unison with one another by suitable sprockets on a common power driven drive shaft. As will be explained below, the conveyor is operated intermittently to deliver rolls of fabric successively as required to the elevator 6.

The second conveyor 2′ of the symmetrical installation as shown in FIG. 1 is the same as the conveyor 2 and is symmetrically arranged with respect to the axis *x—x*. The two conveyors are independently controlled so that one can be used while the other is idle. However, at any given time fabric may be stored on both conveyors thereby providing greater storage capacity.

The elevator 6 comprises a base 6*a* which is supported on the floor F1 of the cutting room by wheels 6*b* so that the elevator can be moved toward or away from the end of the cutting table. Upright standards 26 project up from the base and are braced by angle braces 26*a*. A fork 7 is movable upwardly along the upright standards 26 by cables 36 which run over pulleys 37 mounted on the upper end of a piston of hydraulic cylinder 38, the upper ends of the cables being anchored to the upper end of the cylinder as indicated at 36*a*. It will be seen that upward movement of the pulleys 37 produces upward movement of the fork 7, the travel of the fork being twice that of the pulleys.

Figure 6:
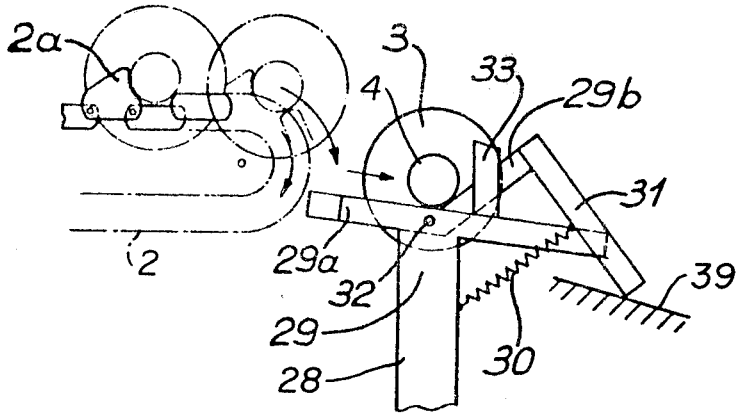
FIG. 6 is a schematic side view of a fork of the elevator in bottom position and an adjacent portion of the chain conveyor.
Figure 7:
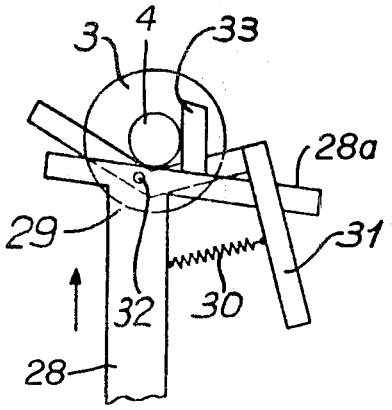
FIG. 7 is a schematic side view of the fork of the elevator in elevating position.

The fork 7 has upright arms 28 for supporting a roll of fabric to be elevated, the roll being supported by the projecting ends of the support tube 4. At the upper end of each of the upright arms 28 there is provided a cross arm 28*a* and a V-shaped bracket 29 pivotally mounted on the arm 28 by a bolt 32. When the fork 7 is in its lower position to receive a roll of fabric from the conveyor 2, an arm 31 fixed on a arm 29*b* of the bracket 29 engages a support surface 39 causing the bracket 29 to assume the position shown in FIG. 6 with the arm 29*a* coincident with the cross arm 28*a* of the arms 28. In this position the projecting end portion of the support tube 4 of a roll of fabric 3 discharged from the conveyor 2 is received on and supported by the bracket 29 and the cross arm 28*a* as seen in FIG. 6. As the fork 7 of the elevator starts to rise, the bracket 29 is rotated to the position shown in FIG. 7 by a spring 30 attached to the arm 31 causing the support tube 4 of the fabric roll 3 to roll back against a block 33. When the elevator fork has been raised to the level of a support 9 located above the cutting table, a cam (not shown) causes the angle bracket 29 to tilt in a counterclockwise direction to the position shown in FIG. 8 thereby causing the support tube of the roll 3 to roll off of the fork 7 onto the support 9 which transports it to the carriage 8.

Figure 8:
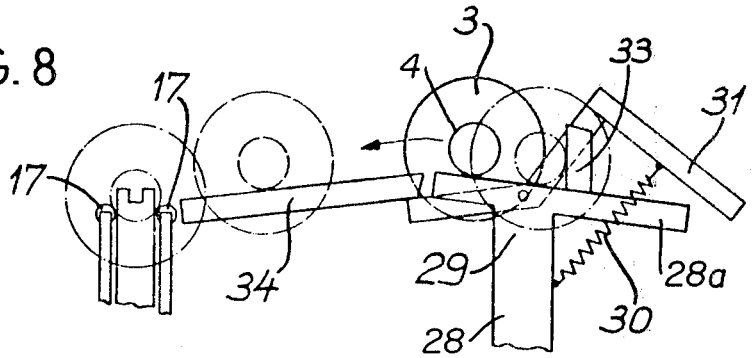
FIG. 8 is a schematic side view showing the fork of the elevator in top position together with a portion of the carriage and means for transferring a roll of fabric from the elevator to the carriage.

As seen in FIG. 1 the support 9 is located above an end of the cutting table 5. The support member comprises rails 34 which are spaced apart a suitable distance to support a roll of fabric by the projecting ends of the support tube 4. The rails are supported from the ceiling or a suitable overhead structure by downwardly extending support members 34*a*. As seen in FIGS. 1 and 8, the rails 34 are inclined downwardly toward the carriage 8 so that a roll of fabric discharged onto the support 9 by the elevator 6 will roll down the rails 34 to the carriage 8 when the carriage is at the end of the cutting table as seen in FIG. 1.

Figure 3:
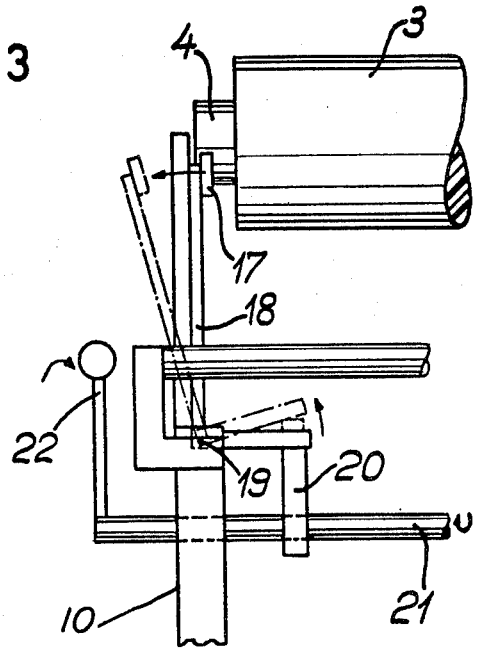
FIG. 3 is an enlarged view of the portion A of FIG. 2.
Figure 4:
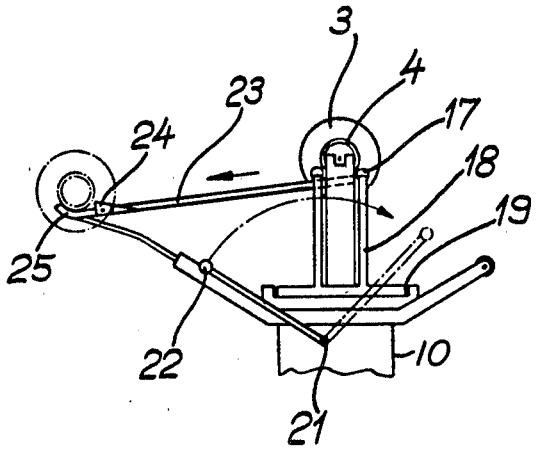
FIG. 4 is an elevation of the fabric support turret and associated parts at one end of the unwinding carriage.
Figure 5:
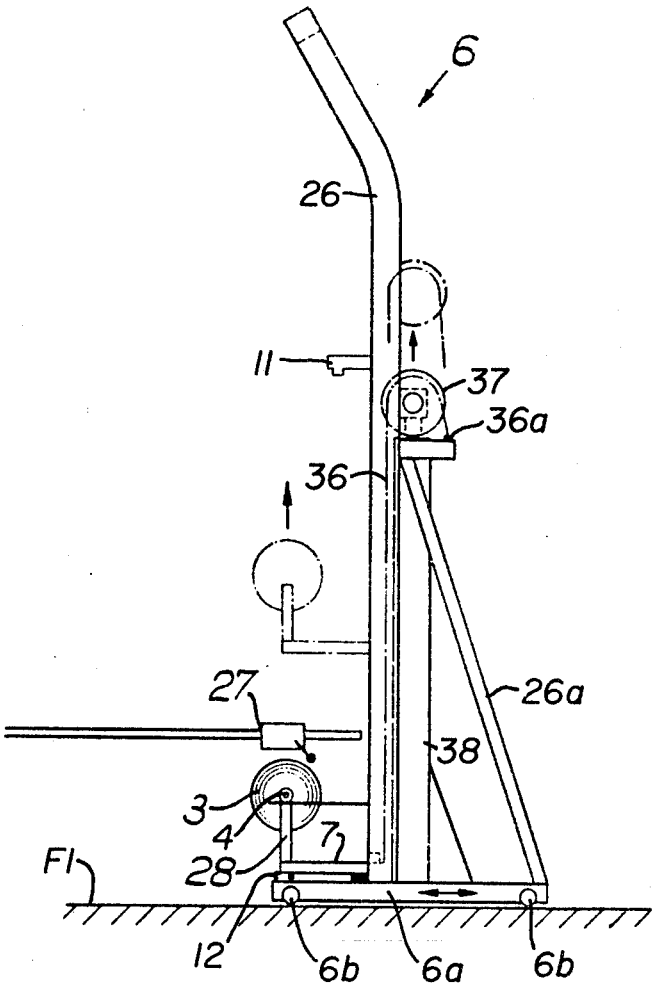
FIG. 5 is a schematic side view of the elevator.

The carriage 8 is movable along the rails 15 in a direction lengthwise of the cutting table 5 by a motor M and is provided with a platform 16 on which an operator rides. Controls for the carriage and for other components of the installation are provided on a suitable control panel on the carriage in a position in which they are convenient to an operator riding on the platform 16. The carriage is further provided with turrets 10 for supporting a fabric roll by the projecting ends of the support tube 4. The tube is rotatably supported by rollers 17 at the upper end of an angle bracket 18 which is provided on a support by a pivot pin 19. Pivotal movement of the bracket 18 is controlled by a cam 20 on a shaft 21 provided at its outer end by a control lever 22. When a roll of fabric is to be received by the carriage 8 from the elevator 6 the bracket 18 is in the position shown in solid lines in FIG. 3 so that as the support tube of the fabric roll rolls down the inclined rails 34 of the support 9, it is received by the pair of rollers 17 on the bracket 18 so as to be supported for rotation of the roll of fabric for unwinding the fabric from the roll as the carriage moves along the cutting table. When, the desired amount of fabric has been unwound from the roll and it is desired to discharge a partially used roll of fabric, the control lever 22 is actuated by moving it from the solid line position shown in FIG. 4 to the position shown in broken lines. The angle bracket 18 is thereby tilted outwardly to the position shown in broken lines in FIG. 3 thereby disengaging the rollers 17 from the support tube 4 and freeing the tube to rest on inclined angle irons 23. The fabric roll rolls down the angle irons 23 in the direction of the arrow in FIG. 4. Under the effect of its own weight, the roll 3 passes over angle iron brackets 24 and comes to rest against crooks 25. The partially used roll of fabric is then in position to be removed by the overhead hoist 13.

The hoist 13 is an overhead power operated hoist having a tackle 40 suspended by a pulley 41 and cable 42 from a carriage 43 in which runs along an overhead rail 14 and is provided with a drum 44 for winding up the cable to raise the tackle. The tackle 40 is provided with downwardly extending arms 40*a* which are spaced apart to receive a roll of fabric lengthwise between them. At the lower ends of the arms 40*a* there are pivoted spring loaded fingers 45 which are adapted to enter opposite ends of the support tube of a roll of fabric as indicated in FIG. 11 so as to support the fabric roll by the support tube 5. In FIG. 10 counterweights 46 are shown fixed on the tackle 40 so as to keep it in an upright position.

The hoist 13 is controllable by an operator riding on the platform 16 of the carriage 8 so as to lift a partially used roll of fabric from the carriage 8, lift it upwardly from the carriage, move it along the rail 14 to a position beyond the end of the cutting table and then lowered the roll of fabric through an opening zero in the floor F1 of the cutting room into the storage room S located below the cutting room. The roll of fabric can then be stored in the storage room until it is to be reused whereupon the roll is again placed on the conveyor 2.

The pivoted fingers 45 on the tackle 40 permit automatic pick up and release of a roll of fabric. The fingers are pivoted so as to swing up from the position shown in FIG. 11 but are spring loaded to return to that position. When it is desired to pick up a roll, the tackle is lowered so that the fingers 45 engage the projecting ends of the support tube 4. The fingers swing up and then snap back into position inside the ends of the support tube so that the roll can be lifted by the tackle. When it is desired to release a roll after it has been transported to the storage area, the tackle 40 is lowered so that the fingers 45 swing up and out of the support tube.

Figure 12:
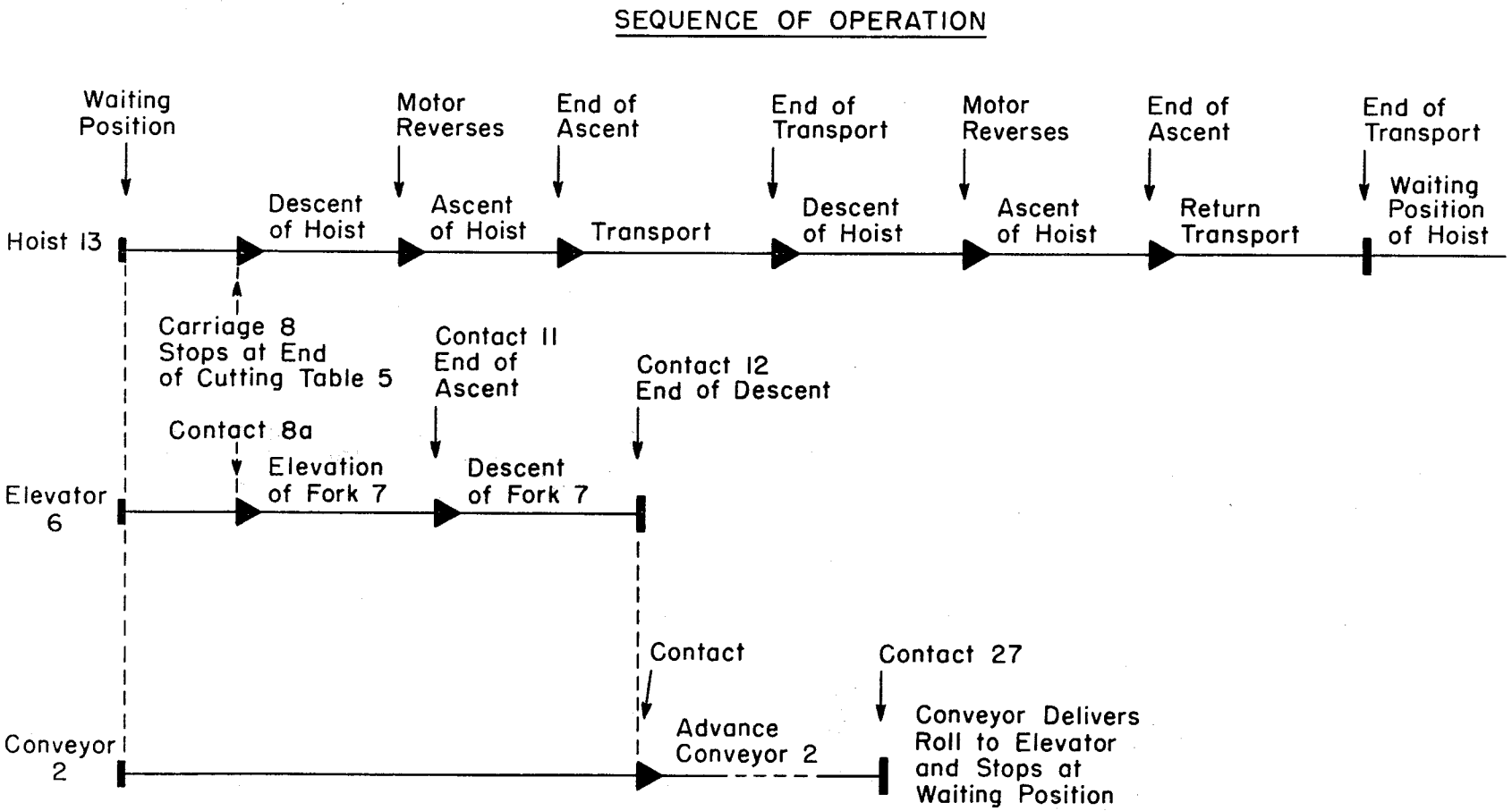
FIG. 12 is a schematic view illustrating sequential operation of the several components of the installation automatically controlled by a control circuit.

The operation of the system in accordance with the invention is controlled in part by the operator riding on the platform 16 of the carriage 8 and in part automatically to provide the sequence of operations illustrated in FIG. 12. As will be seen from FIG. 12 the sequence of operation of the system is as follows:

0. In waiting position the fork 7 of the elevator 6 is in its lowermost position with a roll of fabric resting on the arms 28 of the fork 7 in position to be raised by the elevator. The conveyor 2 is stationary in the position in which it stopped after delivering a roll of fabric to the elevator. The tackle 40 of the hoist 13 is in elevated position above the cutting table 5.

1. When the carriage 8 comes to the end of the cutting table 5 it actuates a contact 8*a* which is mounted on the carriage or is mounted in position to be engaged by the carriage. The fork 7 of the elevator 6 rises to lift a roll of fabric for delivery to the carriage. The tackle 40 of the hoist 13 lowers to engage a partially used roll which in the meantime has been released from the rollers 17 of the carriage by actuation of the lever 22 as described above and rests in the crooks 25 at the lower ends of the angle irons 23.

2. The hoist rises and thereby lifts the partially used roll from the carriage 8.

3. When the elevator reaches the height of the transfer support 9 it engages a contact 11 which stops the elevator and starts it back down after a time interval sufficient to discharge the roll of fabric from the fork of the elevator onto the rails 34 of the support 9 which transport it to the carriage.

4. The hoist 13 ends its ascent and moves horizontally along the rail 14 to a position in which it is above the opening zero in the cutting room floor F1.

5. The elevator reaches its bottom position and engages a contact 12 which starts the conveyor 2.

6. The hoist 13 ends its transport movement and the tackle 40 starts to descend.

7. The conveyor 2 delivers a roll of fabric to the elevator. When delivered to the elevator the roll of fabric actuates a contact 27 which stops the conveyor in its waiting position.

8. The hoist 13 delivers the partially used roll of fabric to the storage room below the cutting room. The roll of fabric is thereupon released and the tackle starts up.

9. The hoist reaches it elevated position and moves horizontally to the starting position over the cutting table.

It will be understood that as soon as a roll of fabric has been delivered to the carriage and the partially used previous roll has been removed, the operator can put the carriage in motion to spread the fabric of the newly delivered roll onto the cutting table. When the desired number of layers of fabric have been spread on the right hand half of the cutting table as viewed in FIG. 1, the carriage is run to the opposite end of the cutting table and the sequence of operations is repeated with the conveyor 2′, the elevator 6′, transfer support 9′ and hoist 13′ in cooperation with the carriage 8 to spread successive layers of fabric on the left hand half of the cutting table as viewed in FIG. 1.

In addition to the contact switches and controls that have been mentioned above, suitable circuitry and controls are provided for carrying out the sequence of operations described above and illustrated in FIG. 12. The layout of a suitable control system may be selected as desired and presents no problem to a person skilled in the art.

While a preferred embodiment of apparatus for carrying out the process in accordance with the present invention has been illustrated in the drawings and is herein particularly described, it will be understood that modifications may be made and that the invention is in no way limited to the illustrated embodiment.

What we claim and desire to secure by letters patent is:

1. A system for supplying fabric and laying it in superposed layers on a cutting table in a cutting room of an industrial fabricating plant which comprises winding said fabric on rigid tubes to form a roll, said tubes projecting from opposite ends of the rolls and being strong enough to support the rolls when said tubes are supported by their projecting ends, storing said rolls in a storage room below said cutting room, placing said rolls successively on an upwardly inclined chain conveyor comprising two belts spaced apart a distance approximately equal to the length of said rolls and having teeth for supporting said rolls by the projecting ends of said tubes, transporting said rolls by said conveyor up to said cutting room at a location at one end of said cutting table, transferring said rolls successively to an elevator having means for supporting said rolls by the projecting ends of said tubes, lifting one roll at a time by said elevator to a height above said cutting table, transferring said elevated roll to a carriage spanning said cutting table and running on rails at opposite sides of said cutting table, said carriage having bearing means for rotatably supporting said roll by the projecting ends of said tube, and moving said carriage along the cutting table while unwinding said roll to lay said fabric on the cutting table.

2. A system according to claim 1, in which partially used fabric rolls are hoisted from said carriage and returned to said storage room.

3. A system according to claim 2, in which said roll when partially used is remove from said bearings and rolled down inclined supports which support said partially used roll by the projecting ends of said tube to a position from which it is hoisted for return to said storage room.

4. A system according to claim 1, in which said rolls are transferred from said elevator to said carriage by rolling down inclined rails supporting said roll by the projecting ends of said tube.

5. A system for supplying fabric and laying it in superposed layers on a cutting table in a cutting room of an industrial fabricating plant which comprises a storage room for rolls of fabric located below said cutting room, each of said rolls comprising fabric wound on a supporting rigid tube which projects from opposite ends of the roll and is strong enough to support the roll when said tube is supported by its projecting ends, inclined conveyor means for conveying rolls of fabric from said storage room up to said cutting room at a location adjacent one end of said cutting table, said conveyor means comprising two belts spaced apart a distance approximately equal to the length of said rolls and having teeth for supporting said rolls by the projecting ends of said tubes, elevator means for taking rolls successively from said conveyor means and lifting one roll at a time to a height above said cutting table, said elevator means having means for supporting and lifting said rolls by the projecting ends of said tubes, a carriage spanning said cutting table and running on rails at opposite sides of said cutting table, means for transferring said rolls one at a time from said elevator means to said carriage, said carriage having bearing means for rotatably supporting said roll by the projecting ends of said tube for rotation of said roll to unwind the fabric and lay it on said table as said carriage moves along said table.

6. A system according to claim 5, in which said transferring means comprises rails for supporting said roll by the projecting ends of said tube, said rails being inclined downward toward said bearing means of said carriage, whereby said roll rolls down said rails from said elevator means to said carriage.

7. A system according to claim 6, in which said rails are supported independently of said elevator means and said carriage at selected location at said one end of said cutting table and at a selected height.

8. A system according to claim 5, in which said carriage includes means for supporting an operator to ride on said carriage and a control panel accessible to said operator, said control panel including means for controlling operation of said carriage, operation of said conveyor means, operation of said elevator means and operation of said transferring means.

9. A system according to claim 8, further comprising overhead travelling hoist means for lifting a partially used fabric roll from said carriage, transporting it from over said cutting table and lowering it to said storage room for reuse, said hoist means comprising means for supporting and lifting said roll by the projecting ends of said tubes, and said control panel including means for controlling said hoist.

10. A system according to claim 5, further comprising overhead travelling hoist means for lifting a partially used fabric roll from said carriage, transporting it from over said cutting table and lowering it to said storage room for reuse, said hoist means comprising means for supporting and lifting said roll by the projecting ends of said tube.

11. A system according to claim 10, in which said supporting means of said hoist means includes spring loaded pivoted fingers adapted to enter the end of said tube to support and lift said roll.

12. A system according to claim 5, in which like elevator means are provided at opposite ends of said cutting table and like conveyor means are provided for delivering fabric rolls from said storage room to said elevator means respectively, there being a single carriage movable the full length of said cutting table and adapted to receive fabric rolls from either of said elevator means whereby fabric is laid on one half of the cutting table while fabric is being cut on the other half of the cutting table.

* * * * *